US005450904A

United States Patent [19]

Galle

[11] Patent Number: 5,450,904

[45] Date of Patent: Sep. 19, 1995

[54] ADJUSTABLE TIEBACK SUB

[75] Inventor: Gary L. Galle, Houston, Tex.

[73] Assignee: ABB Vetco Gray Inc., Houston, Tex.

[21] Appl. No.: 294,674

[22] Filed: Aug. 23, 1994

[51] Int. Cl.[6] ..... E21B 33/038

[52] U.S. Cl. ..... 166/348; 166/367; 166/378; 166/381

[58] Field of Search ..... 166/348, 349, 350, 367, 166/368, 378, 381

[56] References Cited

U.S. PATENT DOCUMENTS

| | | | |
|---|---|---|---|
| 4,258,792 | 3/1981 | Restarick | 166/378 |
| 4,408,783 | 10/1983 | Gruller . | |
| 4,466,487 | 8/1984 | Taylor, Jr. | 166/348 X |
| 4,607,865 | 8/1986 | Hughes | 285/18 |
| 4,653,589 | 3/1987 | Alandy . | |
| 4,681,166 | 7/1987 | Cuiper | 166/350 X |
| 4,794,988 | 1/1989 | Van Bilderbeek . | |
| 4,846,508 | 7/1989 | Pallini, Jr. et al. . | |
| 4,909,546 | 3/1990 | Nobileau . | |
| 4,938,289 | 7/1990 | Van Bilderbeek . | |
| 4,995,464 | 2/1991 | Watkins et al. . | |
| 5,002,131 | 3/1991 | Cromar et al. . | |
| 5,127,478 | 7/1992 | Miller | 166/348 |
| 5,181,570 | 1/1993 | Allwin et al. | 166/381 |
| 5,249,629 | 10/1993 | Jennings | 166/348 |
| 5,255,746 | 10/1993 | Bridges . | |
| 5,261,493 | 11/1993 | Brammer | 166/378 |
| 5,311,947 | 5/1994 | Kent et al. | 166/348 |

OTHER PUBLICATIONS

"Adjustment Sub", Dril-Quip, Technology for the 90's (4 pages).

*Primary Examiner*—Ramon S. Britts
*Assistant Examiner*—Frank S. Tsay
*Attorney, Agent, or Firm*—James E. Bradley

[57] ABSTRACT

A method of tensioning casing between a subsea well and a surface wellhead employs an adjustment sub. The adjustment sub has upper and lower portions connected together by a threaded section. The running tool locates within the adjacent sub and is employed to secure the lower end of the casing to a tieback latch within the subsea housing. Continued rotation shears out a lower portion of the running tool, causing the threaded section to rotate relative to at least one of the other portions. Rotation of the threaded section brings a hanger on the upper sub portion downward into engagement with a load shoulder in the surface housing.

21 Claims, 3 Drawing Sheets

ADJUSTABLE TIEBACK SUB

BACKGROUND OF THE INVENTION

1. Field of the Invention

This invention relates in general to a system for tensioning a section of casing extending between a subsea well housing and a surface wellhead located on an offshore platform, and in particular to a system utilizing a rotatable running tool and an adjustable sub.

2. Description of the Prior Art

In one type of offshore drilling, particularly employed with jack-up drilling rigs, a wellhead housing will be located at the platform. A string of casing in the well will be supported in a subsea well housing, either by a mudline hanger or by a casing hanger. A string of casing extends from the subsea housing to the surface wellhead. Adjustment of the length of this casing string is required since the distance from the subsea well and the surface wellhead is not known, and the distance varies from well to well. Also, the string of casing between the subsea housing and surface wellhead needs to be tensioned.

Currently, there are three basic ways of providing adjustment and tensioning. One manner is to incorporate a removable load ring on the casing hanger. This load ring is usually threaded and rotated until it rests on the load shoulder of the surface wellhead high pressure housing. The second method entails the movement of the entire surface wellhead relative to the subsea housing. Each wellhead is adjusted and will be a different height relative to the platform floor. The third means of adjustment is to effectively change the length of the casing by having an adjustment sub within the casing string. The length of the casing is adjusted by various means so that the casing hanger will rest on the high pressure housing load shoulder. While workable, improvements are desired.

SUMMARY OF THE INVENTION

In this invention, the string of conduit between the subsea well and the load shoulder incorporates an adjustment sub, which in turn is supported by a running tool. The adjustment sub has a lower sub portion and an upper sub portion, the upper sub portion having a hanger on its upper end which will land on the load shoulder within the surface wellhead. The upper and lower sub portions are carried together by a threaded section so that rotation of the threaded section in one direction relative to at least one of the sub portions causes the sub portions to move toward each other. The threaded section is initially positioned such that the length from the lower end of the conduit to the hanger is greater than the distance from the latch at the subsea housing to the load shoulder.

The running tool has a lower tool body and an upper tool body, the upper tool body engaging the threaded section of the adjustment sub, and the lower tool body engaging the lower sub portion. The running tool has a shear pin which transmits torque from the upper tool body to the lower tool body until a selected torque level is reached. Then the shear pin shears and the upper tool body will rotate relative to the lower tool body.

In the method of installation, the running tool body first causes the lower end of the string of conduit to engage the subsea latch or tieback receptacle. The operator rotates the drill pipe which supports the running tool, latching the lower end of the conduit to the tieback member in the subsea housing. The operator then continues the rotation, shearing the shear pin, the continued rotation causing the upper and lower sub portions to move toward each other. This continues until the hanger contacts the load shoulder in the surface wellhead and a selected tension is reached.

Figure 1:
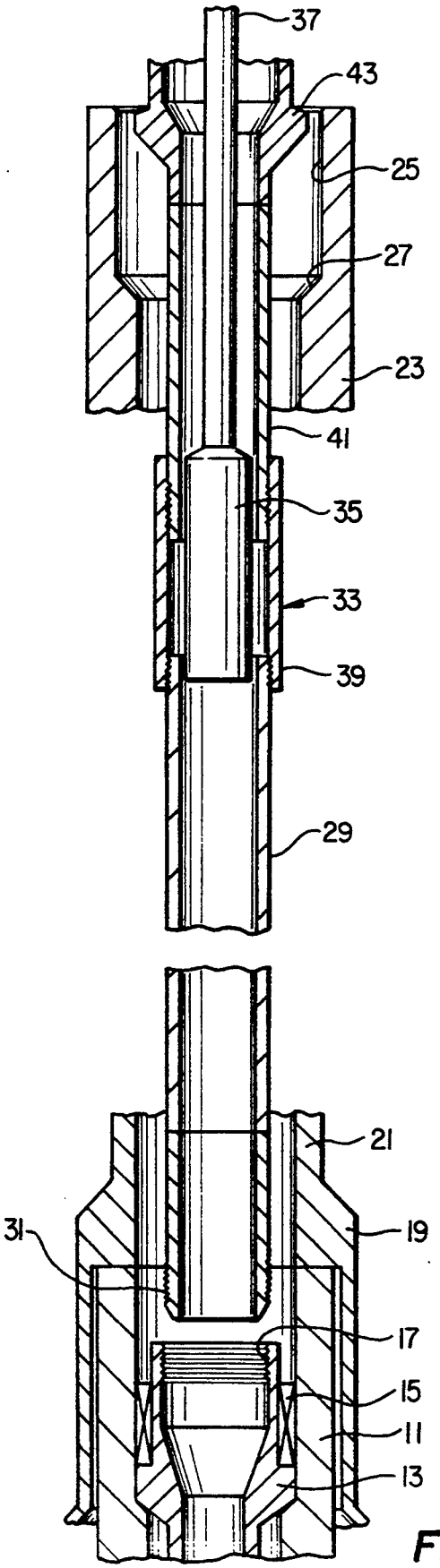
FIG. 1 is a schematic sectional view illustrating a first embodiment of the apparatus and method of this invention.

FIGS. *2a* and *2b* comprise a vertical sectional view illustrating the running tool and adjustment sub utilized with the system shown in FIG. 1, with the right side shown in a running position and the left side shown in a retrieving position.

FIGS. *3a* and 3B comprise a vertical sectional view of an alternate embodiment of an adjustment sub for use with the system shown in FIG. 1, with the running tool not being shown.

DETAILED DESCRIPTION OF THE INVENTION

Referring to FIG. 1, subsea housing 11 will be located on the sea floor. Subsea housing 11 is shown to be of a type having a casing hanger 13 installed within and an annulus seal 15 which seals casing hanger 13 to the bore of subsea housing 11. Casing hanger 13 has internal tieback threads 17. A funnel 19 is shown landed over housing 11. Funnel 19 is secured to a riser 21, which leads to a surface wellhead 23. Alternately, a mudline system can also be utilized with the invention, wherein a mudline hanger is utilized rather than a casing hanger 13, and no annulus seal such as seal 15 is employed.

In both types, surface wellhead housing 23 will have a bore 25 and a load shoulder 27 contained therein. A conduit 29 extends from subsea housing 11 to surface wellhead housing 23. Conduit 29 comprises sections of casing of the same diameter as the casing supported by casing hanger 13 and may have a length that is several hundred feet or more. Conduit 29 is a string of casing which has a tieback connector 31 on its lower end, which in the embodiment shown engages tieback threads 17. In the case of a mudline hanger (not shown), tieback connecter 31 would engage a mudline latch. In both cases, the lower end of conduit 29 latches or secures into subsea housing 11 by means of rotation.

An adjustment sub 33 is incorporated in conduit 29 to adjust the length of conduit 29 to the distance between the tieback threads 17 and the load shoulder 27, and also to apply tension to conduit 29. A running tool 35 is employed to lower conduit 29 into subsea housing 11, latch tieback connector 31 to tieback threads 17, and also adjust the length and apply tension to conduit 29. Running tool 35 is lowered on drill pipe 37 from the platform.

In the first embodiment, adjustment sub 33 is a two-piece design. It has a lower sub portion 39 that secures to the conduit 29. It has an upper portion 41 that extends upward to a hanger 43. Hanger 43 is adapted to land on load shoulder 27. Lower sub portion 39 and upper sub portion 41 are secured together by threads, so that right-hand rotation of the upper sub portion 41 relative to the lower sub portion 39 will cause the upper sub portion 41 to move downward relative to the lower sub portion 39.

Figure 2A:
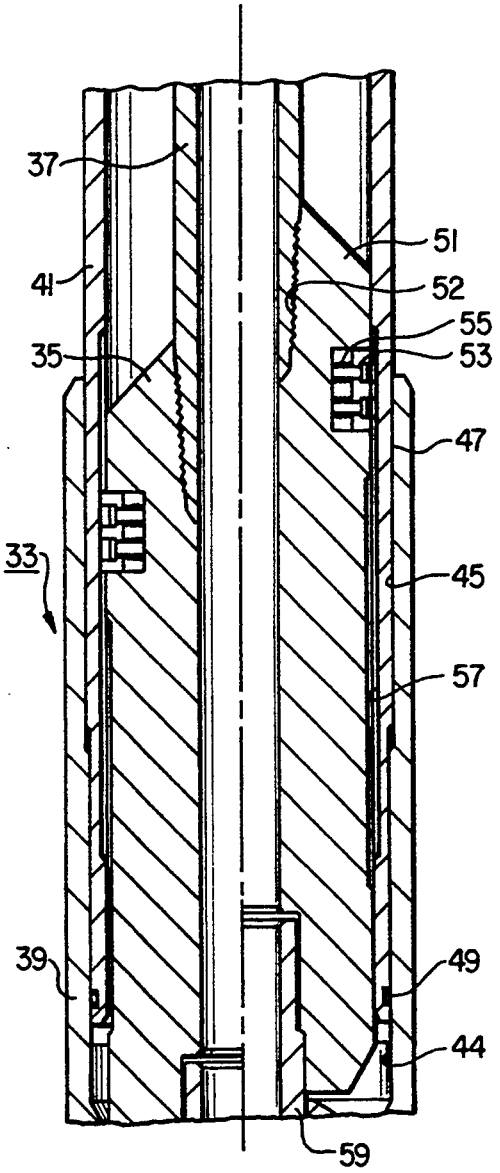
Figure 2B:
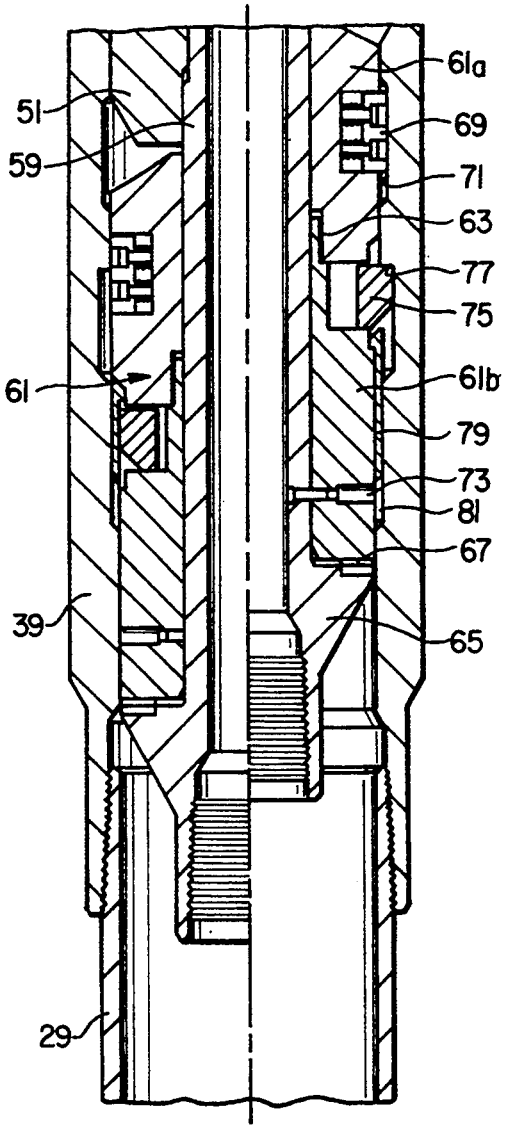

Referring to FIGS. 2*a* and 2*b*, lower sub portion 39 has a bore 44 containing an internal set of threads 45. Upper sub portion 41 has external threads 47 which engage internal threads 45. A combination metal and elastomer seal 49 on the exterior of upper sub portion 41 seals against bore 44 of lower sub portion 39. Sub 33 may be positioned at selected points along the length of conduit 29, merely by adding sections of casing to upper sub portion 41. However, it is preferred that adjustment sub 33 be located fairly close to surface wellhead 23.

Running tool 35 has an upper body or portion 51 which has threads 52 that secure to the lower end of drill pipe 37. At least one key 53 extends laterally outward from upper body 51. Key 53 is biased outward by coil spring 55. Key 53 is adapted to spring into and locate in a vertical slot 57 formed in the bore of upper sub portion 41. Once in engagement, rotating drill pipe 37 will rotate upper body 51 and upper sub portion 41.

Running tool 35 has a mandrel 59 which secures by threads to the lower end of upper body 51 and extends downward. Mandrel 59 is a tubular member, having a passage therethrough. Mandrel 59 extends through the bore of a lower body 61, which is made up of two portions, key portion 61*a* and a shear portion 61*b*. Shear portion 61*b* secures to key portion 61*a* by means of threads 63, rigidly connecting the portions 61*a* and 61*b* together. Mandrel 59 has a flange 65 near its lower end that locates below lower body 61. A bearing 67 locates between flange 65 and the lower end of shear portion 61*b*. Key portion 61*a* has a spring-biased key 69 which is the same type as key 53. Lower key 69 engages a lower slot 71 formed in lower sub portion 39.

A shear pin 73 extends radially between mandrel 59 and key portion 61*b*. Unless sheared, shear pin 73 links upper body 51 and lower body 61 together for rotation. Once sheared, upper body 51 and mandrel 59 will rotate relative to lower body 61.

A lifting ring 75 locates in a recess formed between lower body portions 61*a* and 61*b*. Lifting ring 75 is a split ring which is biased outward for engaging a downward facing load shoulder 77 formed in the bore 44 of lower sub portion 39. Pulling upward on drill pipe 37 will transmit an upward force through mandrel 59, mandrel flange 65, shear portion 61*b*, to lifting ring 75 and load shoulder 77. A cam sleeve 79 locates below lifting ring 75 for moving lifting ring 75 from the expanded position shown on the right side of FIG. 2*b* to the contracted position on the left side of FIG. 2*b*. Cam sleeve 79 is slidably carried on shear portion 61*b*. Cam sleeve 79 is positioned to engage a cam shoulder 81 in the bore 44 of lower sub portion 39 when running tool 35 is lowered relative to adjustment sub 33. Downward movement of running tool lower body 61 relative to cam sleeve 79 engages a bevel on the lifting ring 75 and then pushes it inward to the retracted position.

In the operation of the embodiment of FIGS. 1 and 2, surface wellhead 23 will be supported above subsea housing 11 upon a platform and interconnected by riser 21. The well would have been previously drilled at least to a certain depth, and a casing hanger 13 or mudline latch (not shown) installed. The operator makes up a string of conduit 29, section by section, and lowers it toward the subsea housing 11. The operator will secure adjustment sub 33 to the upper end of the string of conduit 29. The upper sub portion 41 will be screwed into the lower sub portion 39 to provide a length that is greater from the tieback connector 31 to the hanger 43 than the distance from the tieback threads 17 to the load shoulder 27.

While supporting the string of conduit 29 with slips (not shown) on the rig floor, the operator positions running tool 35 within adjustment sub 33 in the position shown on the right side of FIGS. 2*a* and 2*b*. Lifting ring 75 will engage load shoulder 77, upper key 53 will engage upper slot 57, and lower key 69 will engage lower slot 71. Shear pin 73 will be intact. The operator lowers drill pipe 37 until tieback connector 31 engages tieback threads 17. The operator then rotates drill pipe 37, causing the entire string of conduit 29 to rotate. The upper sub portion 41 rotates because of upper key 53 in upper slot 57. The conduit 29 and lower sub portion 39 rotate because of mandrel 59 transmitting torque through shear pin 73 to shear body 61*b*, lower key 69 and lower slot 71.

This rotation occurs until tieback connector 31 fully makes up with tieback thread 17. The operator applies an overpull to the drill pipe 37, stretching conduit 29 by means of lifting ring 75. The operator then continues rotation of drill pipe 37 while maintaining the tension on the drill pipe 37. The torque will cause shear pin 73 to shear. Once sheared, the torque on mandrel 59 will no longer transmit to lower sub portion 61. Consequently, upper body 51 and upper sub portion 41 will rotate relative to lower body portion 61 and lower sub portion 39. This rotation causes threads 45, 47 to advance upper sub portion 41 downward toward lower sub portion 39. Bearing 67 facilitates the rotation of mandrel 59 relative to lower body 61.

During the rotation, hanger 43 will rotate with upper sub portion 41 relative to surface wellhead 23. Hanger 43 will move downward until it is in engagement with load shoulder 27. The operator then stops rotating and releases tension in drill pipe 37, causing hanger 43 to tightly load against load shoulder 27. The tension will remain in the string of conduit 29, which was stretched during the overpull by the drill pipe 37.

The running tool 35 is retrieved by lowering drill pipe 37 after hanger 43 has fully engaged load shoulder 27. Referring to the left side of FIGS. 2*a* and 2*b*, cam sleeve 79 will engage cam shoulder 81 as running tool 35 is lowered. Cam sleeve 79 will remain stationary once in engagement with cam shoulder 81, with continued lowering of running tool 35 causing cam sleeve 79 to push lifting ring 75 inward to the position shown on the left side. The operator then picks ups on the drill pipe 37, pulling running tool 35 from adjustment sub 33. Keys 53 and 69 will slide out of the respective slots 57 and 71. An annulus seal (not shown) may then be placed between the hanger 43 and bore 25 of surface housing 23.

Figure 3A:
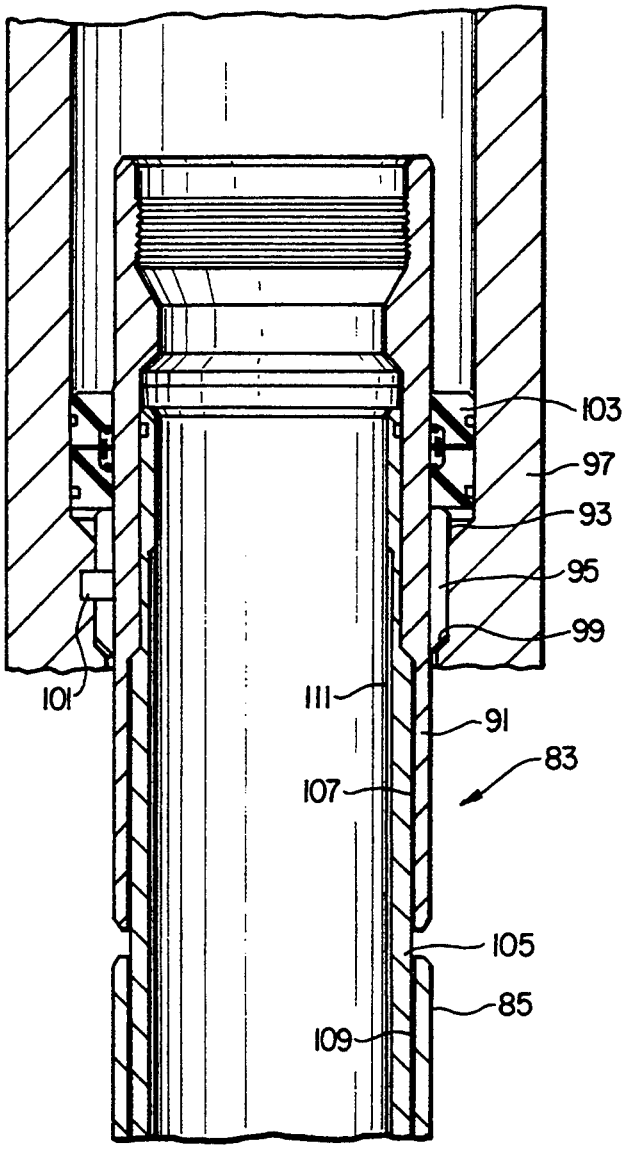
Figure 3B:
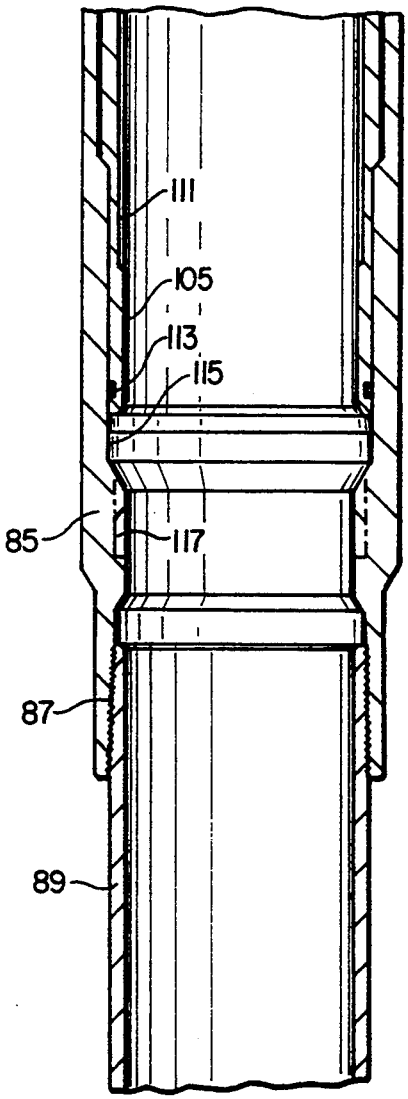

FIGS. 3*a* and 3*b* illustrate an embodiment which is of a three-piece design, but can employ the same running tool 35 as previously described. Adjustment sub 83 has a lower sub portion 85 which has internal threads 87 in its bore. Conduit 89, which extends to the subsea housing (subsea housing 11 in FIG. 1), secures to the threads 87. An upper sub portion 91 has a hanger 93 located thereon. Hanger 93 has a plurality of slots 95 and is adapted to land in wellhead housing 97 on shoulder 99. A anti-rotation pin 101 will engage one of the slots 95 to prevent rotation of upper sub portion 91 relative wellhead housing 97. A seal 103 seals the annulus surrounding upper sub portion 91 within wellhead housing 97.

An internal threaded sleeve 105 interconnects upper sub portion 91 with lower sub portion 85. Threaded sleeve 105 has a set of upper threads 107 on its exterior which engage internal threads in upper sub portion 91. Similarly, threaded sleeve 105 has a set of lower threads 109 that engage threads formed in lower sub portion 85. Upper threads 107 and lower threads 109 are opposite each other in direction so that rotating sleeve 105 in a right-hand direction relative to upper sub portion 91 and lower sub portion 85 will cause them to move toward each other.

An upper slot 111 is formed in the bore of threaded sleeve 105 for engagement by upper key 53 (FIG. 2*a*) of running tool 35. A combination metal and elastomer seal 113 seals threaded sleeve 105 to the bore 115 of lower sub portion 85. A lower slot 117 is formed in bore 115 below threaded sleeve 105. Lower key 69 of running tool 35 (FIG. 2*b*) will engage lower slot 117.

The operation of the second embodiment is similar. Referring also, to FIGS. 1, 2*a* and 2*b*, the string of conduit 89 is made up and lowered into the riser 21 (FIG. 1). Adjustment sub 83 is secured to the upper end of conduit 89. The lower end of conduit 89 is lowered into contact with the subsea housing 11 (FIG. 1), but not yet latched. The running tool 35 (FIG. 2*a,b*) is then positioned in adjustment sub 83. Its upper key 53 engages upper slot 111 and its lower key 69 engages lower slot 117. The lifting ring 75 remains retracted by cam sleeve 79 and is not required for use with adjustment sub 83. The threaded sleeve 105 has been positioned such that hanger 93 is located above shoulder 99 at this point.

The operator rotates drill pipe 37, causing rotation of threaded sleeve 111 and lower sub portion 85. As the hanger slot 95 has normally not yet engaged rotation pin 101, hanger 93 may rotate also. The rotation of drill pipe 37 causes rotation of the string of conduit 29 through the shear pin 73 (FIG. 2*a*, 2*b*). The tieback connector (not shown) on the lower end will engage the tieback threads 17 in the subsea housing 11. Continued rotation then causes the shear pin 73 (FIG. 2*b*) to shear. Even though upper sub portion 91 may rotate, lower sub 85 will not rotate because of its engagement with the subsea housing 11.

Rotation of the drill pipe 37 (FIG. 1) therefore causes the threaded sleeve 105 to rotate relative to the lower sub portion 85, moving the hanger 93 downward toward load shoulder 99. A hanger slot 95 will engage anti-rotation pin 101, preventing rotation of hanger 93 before it comes into contact with load shoulder 99. Continuing rotation causes hanger 93 to contact load shoulder 99 and a desired amount of tension to be placed in the string of conduit 89. The running tool 35 is removed by simply pulling upward.

The invention has significant advantages. The running tool both latches the string of casing to the subsea housing as well as providing the desired tensioning. The running tool is simple in operation and construction.

While the invention has been shown in only two of its forms, it should apparent to those skilled in the art that it is not so limited, but is susceptible to various changes without departing from the scope of the invention.

I claim:

1. A method of running a string of conduit between a latch member in a subsea well and a load shoulder in a surface wellhead on a platform, comprising:

connecting to the string of conduit a sub which has a lower sub portion and an upper sub portion, the upper sub portion having a hanger on its upper end adapted to engage the load shoulder, the upper and lower sub portions being carried together by a threaded section so that rotation of the threaded section in a selected direction relative to at least one of the sub portions causes the sub portions to move axially toward each other, the threaded section being initially positioned such that the length from a lower end of the conduit to the hanger is greater than the distance from the latch member to the load shoulder;

providing a running tool which has a lower tool portion which will engage the lower sub portion and an upper tool portion which will engage the threaded section of the sub, and providing the running tool with shear means for transmitting torque from the upper tool portion to the lower tool portion until a selected level is reached and then for allowing rotation of the upper tool portion relative to the lower tool portion;

lowering the running tool into the sub on a pipe and engaging the lower sub portion and threaded section of the sub with the lower tool portion and upper tool portion, respectively; then lowering the string of conduit until the lower end of the conduit engages the latch member; then rotating the pipe and thereby the upper and lower tool portions, causing the lower portion of the sub to rotate the lower end of the conduit into locking engagement with the latch member, at which time the hanger will be spaced above the load shoulder; then continuing to rotate the pipe, causing the shear means to shear and the upper tool portion and threaded section to rotate relative to the lower tool portion and lower end of the conduit, moving the upper sub portion downward until the hanger contacts the load shoulder and a selected amount of tension in the string of conduit is reached; then retrieving the running tool and pipe from the sub.

2. The method according to claim 1, further comprising applying tension to the pipe and running tool after the lower end of the conduit is in locking engagement with the latch member and before continuing to rotate the pipe.

3. The method according to claim 1, wherein the step of continuing to rotate the pipe causes rotation of the upper sub portion and the hanger with the threaded section.

4. The method according to claim 1, wherein the step of continuing to rotate the pipe causes the threaded section to rotate also relative to the upper sub, which remains free of rotation.

5. The method according to claim 1, wherein the step of retrieving the running tool comprises lowering the running tool relative to the sub, then lifting the running tool.

6. A method of running a string of conduit between a latch member in a subsea well and a load shoulder in a surface wellhead on a platform, comprising:

connecting to the string of conduit a sub which has a lower sub portion and an upper sub portion, the upper sub portion having a hanger on its upper end adapted to engage the load shoulder, the upper and lower sub portions being screwed together by a threaded section so that rotation of one of the sub portions in a selected direction relative to the other causes the sub portions to move axially toward each other, the threaded section being initially positioned such that the length from a lower end of the conduit to the hanger is greater than the distance from the latch member to the load shoulder;

providing a running tool which has a lower tool portion which will engage the lower sub portion for supporting weight and applying torque and an upper tool portion which will engage the threaded section of the sub for applying torque, and providing the running tool with shear means for transmitting torque from the upper tool portion to the lower tool portion until a selected level is reached and then for allowing rotation of the upper tool portion relative to the lower tool portion;

lowering the running tool into the sub on a pipe and engaging the lower sub portion and threaded section of the sub with the lower tool portion and upper tool portion, respectively; then lowering the string of conduit with the running tool and pipe until the lower end of the conduit engages the latch member; then rotating the pipe and thereby the upper and lower tool portions, causing the lower portion of the sub to rotate the lower end of the conduit into locking engagement with the latch member, at which time the hanger will be spaced above the load shoulder; then continuing to rotate the pipe, causing the shear means to shear and the upper tool portion, threaded section, and upper sub portion to rotate relative to the lower tool portion and lower end of the conduit, moving the upper sub portion downward until the hanger contacts the load shoulder; then retrieving the running tool and pipe from the sub.

7. The method according to claim 6, further comprising applying tension to the string of conduit by overpulling the pipe after the lower end of the conduit is in locking engagement with the latch member and before continuing to rotate the pipe, and continuing to apply tension while rotating the pipe.

8. The method according to claim 6, wherein the step of continuing to rotate the pipe causes rotation of the hanger with the upper sub portion.

9. The method according to claim 6, wherein the step of retrieving the running tool comprises lowering the running tool relative to the sub, then lifting the running tool.

10. A method of running a string of conduit between a latch member in a subsea well and a load shoulder in a surface wellhead on a platform, comprising:

connecting to the string of conduit a sub which has a lower sub portion and an upper sub portion, the upper sub portion having a hanger on its upper end adapted to engage the load shoulder, the upper and lower sub portions being connected together by a threaded section so that rotation of the threaded section in a selected direction relative to at least one of the sub portions causes the sub portions to move axially toward each other, the threaded section being initially positioned such that the length from a lower end of the conduit to the hanger is greater than the distance from the latch member to the load shoulder;

providing a running tool which has a lower tool portion which will engage the lower sub portion to transmit torque and an upper tool portion which will engage the threaded section of the sub to transmit torque, and providing the running tool with shear means for transmitting torque from the upper tool portion to the lower tool portion until a selected level is reached and then for allowing rotation of the upper tool portion relative to the lower tool portion;

lowering the running tool into the sub on a pipe and engaging the lower sub portion and threaded section of the sub with the lower tool portion and upper tool portion, respectively;

lowering the string of conduit until the lower end of the conduit engages the latch member; then rotating the pipe and thereby the upper and lower tool portions, causing the lower portion of the sub to rotate the lower end of the conduit into locking engagement with the latch member, at which time the hanger will be spaced above the load shoulder; then continuing to rotate the pipe, causing the shear means to shear and causing the threaded section to rotate relative to at least the lower tool portion, moving the upper sub portion downward until the hanger contacts the load shoulder and continuing to rotate the threaded section until a selected amount of tension in the string of conduit is reached; then retrieving the running tool and pipe from the sub.

11. The method according to claim 10, further comprising restraining the hanger from rotating after it contacts the load shoulder and while continuing to rotate the pipe.

12. An apparatus for running a string of conduit between a latch member in a subsea well and a load shoulder in a surface wellhead on a platform, comprising:

a sub which has a lower sub portion and an upper sub portion, the upper sub portion having a hanger on its upper end adapted to engage the load shoulder, the lower sub portion being adapted to be connected to the string of conduit;

connecting means for connecting the upper and lower sub portions together by a threaded section so that rotation of the threaded section in a selected direction relative to at least one of the sub portions causes the sub portions to move axially toward each other;

a running tool which has a lower tool means for engaging the lower sub portion to transmit torque and an upper tool means for engaging the threaded section of the connecting means to transmit torque;

shear means in the running tool for transmitting torque from the upper tool means to the lower tool means until a selected level is reached and then for allowing rotation of the upper tool means relative to the lower tool means; and means for connecting the running tool to a string of pipe for rotating the pipe and thereby the upper and lower tool means, causing the lower portion of the sub to rotate the lower end of the conduit into locking engagement with the latch member, then for continuing to rotate the pipe, causing the shear means to shear and the upper tool means and threaded section to rotate relative to the lower tool means and lower end of the conduit, moving the upper sub portion downward until the hanger contacts the load shoulder.

13. The apparatus according to claim 12 wherein the threaded section comprises a set of threads on the lower sub portion and a set of threads on the upper sub portion which engage each other.

14. The apparatus according to claim 12 wherein the threaded section comprises a sleeve having a set of upper threads which engage a set of threads provided on the upper sub portion and a set of lower threads which engage a set of threads provided on the lower sub portion.

15. The apparatus according to claim 12 wherein:

the lower sub portion has a support shoulder and a lower torque slot; and the lower tool means comprises a retractable lift member which engages the load shoulder and a lower key which engages the lower torque slot.

16. The apparatus according to claim 12 wherein:

the lower sub portion has a support shoulder and a lower torque slot; and the lower tool means comprises a retractable lift member which engages the load shoulder and a lower key which engages the lower torque slot; and wherein the apparatus further comprises:

a cam shoulder formed in the bore of the lower sub portion below the support shoulder; and a cam sleeve movably carried by the lower tool portion below the lift member for retracting the lift member due to contact with the cam shoulder when the running tool is lowered relative to the lower sub portion, to allow the running tool to be retrieved.

17. The apparatus according to claim 12 wherein:

the threaded section has an upper torque slot; and the upper tool means comprises an upper key which engages the upper torque slot.

18. The apparatus according to claim 12 wherein:

the lower sub portion has a support shoulder and a lower torque slot;

the lower tool means comprises a retractable lift member which engages the load shoulder and a spring-biased lower key which engages the lower torque slot;

the threaded section has an upper torque slot; and the upper tool means comprises a spring-biased upper key which engages the upper torque slot.

19. An apparatus for running a string of conduit between a latch member in a subsea well and a load shoulder in a surface wellhead on a platform, comprising:

a sub which has a lower sub portion and an upper sub portion, each having a bore, the upper sub portion having a hanger on its upper end adapted to engage the load shoulder;

the upper and lower sub portions each having mating threads so that rotation of one of the sub portions in a selected direction relative to the other causes the sub portions to move axially toward each other;

an upper torque slot located in the bore of the upper sub portion;

a lower torque slot located in the bore of the lower sub;

a support shoulder located in the bore of the lower sub;

a running tool which has a lower tool portion having a lower key and lower lift member for engaging the lower torque slot and support shoulder, respectively, and an upper tool portion having an upper key for engaging the upper torque slot;

shear means in the running tool for transmitting torque from the upper tool portion to the lower tool portion until a selected level is reached and then for allowing rotation of the upper tool portion relative to the lower tool portion; and means for connecting the running tool to a string of pipe for lowering the string of conduit with the running tool and pipe until the lower end of the conduit engages the latch member, then for rotating the pipe and thereby the upper and lower tool portions, causing the lower portion of the sub to rotate the lower end of the conduit into locking engagement with the latch member, then for continuing to rotate the pipe, causing the shear means to shear and the upper tool portion and upper sub portion to rotate relative to the lower tool portion and lower end of the conduit, moving the upper sub portion downward until the hanger contacts the load shoulder.

20. An apparatus for running a string of conduit between a latch member in a subsea well and a load shoulder in a surface wellhead on a platform, comprising:

a sub which has a lower sub portion and an upper sub portion, each having a bore, each having a set of interior threads in the bore, the upper sub portion having a hanger on its upper end adapted to engage the load shoulder;

a threaded sleeve having a bore and a set of upper exterior threads which engage the interior threads of the upper sub portion and a set of lower threads which engage the interior threads of the lower sub portion, such that rotation of the threaded sleeve relative to at least one of the sub portions in a selected direction relative to the other causes the sub portions to move axially toward each other;

an upper torque slot located in the bore of the threaded sleeve;

a lower torque slot located in the bore of the lower sub;

a running tool which has a lower tool portion having a lower key for engaging the lower torque slot, and an upper tool portion having an upper key for engaging the upper torque slot;

the running tool having means for transmitting torque from the upper tool portion to the lower tool portion in a first mode and for allowing rotation of the upper tool portion relative to the lower tool portion in a second mode; and means for connecting the running tool to a string of pipe for rotating the pipe and the upper and lower tool portions while the running tool is in the first mode, causing the lower portion of the sub to rotate the lower end of the conduit into locking engagement with the latch member, then for continuing to rotate the pipe while the running tool is in the second mode, causing the upper tool portion and upper sub portion to rotate relative to the lower tool portion and lower end of the conduit, moving the upper sub portion downward until the hanger contacts the load shoulder and until a selected amount of tension in the string of conduit is reached.

21. The apparatus according to claim 20 wherein the means for transmitting torque comprises:

a mandrel secured to the upper tool portion and received by the lower tool portion for rotation relative to the lower tool portion; and a shear pin located between the lower tool portion and the mandrel to prevent rotation of the mandrel relative to the lower tool portion unless a selected torque is applied.

* * * * *